US009370214B1

(12) United States Patent
Whitcomb

(10) Patent No.: US 9,370,214 B1
(45) **Date of Patent: *Jun. 21, 2016**

(54) HELMET HAVING BLUNT FORCE TRAUMA PROTECTION

(71) Applicant: John E. Whitcomb, Elm Grove, WI (US)

(72) Inventor: John E. Whitcomb, Elm Grove, WI (US)

( * ) Notice: Subject to any disclaimer, the term of this patent is extended or adjusted under 35 U.S.C. 154(b) by 5 days.

This patent is subject to a terminal disclaimer.

(21) Appl. No.: 14/604,856

(22) Filed: Jan. 26, 2015

Related U.S. Application Data

(60) Provisional application No. 61/967,291, filed on Mar. 10, 2014.

(51) Int. Cl.

| | |
|---|---|
| ***A42B 3/12*** | (2006.01) |
| ***A42B 3/00*** | (2006.01) |
| ***A63B 71/10*** | (2006.01) |
| ***A42B 3/06*** | (2006.01) |

(52) U.S. Cl.
CPC . *A42B 3/00* (2013.01); *A42B 3/063* (2013.01); *A63B 71/10* (2013.01)

(58) Field of Classification Search
CPC ..... A42B 3/121; A42B 3/122; A42B 3/128; A42B 1/203; A42B 3/063; A42B 3/065; A42B 3/281; A42C 2/007; A63B 2071/083; A63B 71/10; Y10S 2/03
See application file for complete search history.

(56) References Cited

U.S. PATENT DOCUMENTS

| | | | | |
|---|---|---|---|---|
| 3,872,511 | A * | 3/1975 | Nichols | A42B 3/121 2/413 |
| 3,999,220 | A * | 12/1976 | Keltner | A42B 3/065 2/23 |
| 4,586,200 | A * | 5/1986 | Poon | A42B 3/122 2/413 |
| 5,129,107 | A * | 7/1992 | Lorenzo | A42B 1/203 2/413 |
| 5,669,079 | A * | 9/1997 | Morgan | A42B 3/128 2/412 |
| 6,336,220 | B1 * | 1/2002 | Sacks | A41D 31/005 116/203 |
| 6,709,062 | B2 * | 3/2004 | Shah | A42B 3/0473 2/410 |
| 8,739,317 | B2 * | 6/2014 | Abernethy | A42B 3/121 2/410 |
| 8,844,066 | B1 * | 9/2014 | Whitcomb | A42B 3/121 2/413 |
| 8,898,818 | B1 * | 12/2014 | Whitcomb | A42B 3/122 2/413 |
| 9,173,445 | B1 * | 11/2015 | Whitcomb | A42B 3/121 |
| 9,289,023 | B2 * | 3/2016 | Archbold | A42B 3/121 |
| 2011/0252544 | A1 * | 10/2011 | Abernethy | A42B 3/121 2/413 |
| 2013/0283506 | A1 * | 10/2013 | Archbold | A42B 3/121 2/413 |

* cited by examiner

*Primary Examiner* — Bobby Muromoto, Jr.
(74) *Attorney, Agent, or Firm* — Donald J. Ersler

(57) ABSTRACT

A helmet having blunt force trauma protection includes a prior art helmet and a replaceable impact layer. The replaceable impact layer preferably includes at least one gas cell layer, a removable attachment system and an outer layer of sheet material. The at least one gas cell layer includes a plurality of gas cells created between two plastic sheets. Each cell will burst upon a pre-determined impact. The plurality of cells preferably have a hexagon shape, but other shapes may also be used, such as round or square. The removable attachment system is preferably hook and loop fasteners, but other suitable removable attachment systems may also be used. At least one first pad of hook and loop fasteners is attached to an exterior surface of a prior art helmet and at least one second pad of hook and loop fasteners is attached to a bottom surface of the replaceable impact layer.

20 Claims, 4 Drawing Sheets

HELMET HAVING BLUNT FORCE TRAUMA PROTECTION

CROSS-REFERENCES TO RELATED APPLICATIONS

This is a non-provisional application taking priority from provisional application No. 61/967,291 filed On Mar. 10, 2014.

BACKGROUND OF THE INVENTION

1. Field of the Invention

The present invention relates generally to helmets and more specifically to a helmet having blunt force trauma protection, which includes a replaceable impact layer.

2. Discussion of the Prior Art

The purpose of protective helmets is to prevent head injury incurred during some event, such as football, ice hockey, horseback riding, skiing, lacrosse, baseball, cricket, sky diving (or any other sport using a helmet), riding a motorcycle, construction and military combat. Helmets were first invented for protection in military engagements, and as such, started as protection from hand held weapons and evolved in the 20' Century to protect from projectiles and explosives. As such, rigid, impenetrable helmets have been the paradigm we have used for the prevention of head injuries.

Rigid helmets have been partially successful at preventing injuries. However, the recent epidemic of concussions and the increasing awareness of the cumulative problems associated with repeated head trauma have unpacked the limitations of the current structure of protective helmets in all sports. Indeed, the same limitation could be claimed for all protective helmets including construction and military helmets.

The physics of head injury is all focused on the distance over which deceleration occurs. The human brain is very fragile, being composed of cells wrapped in membranes made of fluid fatty acids. Several trillion synapses in the brain are delicately poised in proximity to one another, without rigid and strong connections. These synapses are the functional means by which the brain operates. Shaking them disrupts them. The human nervous system has developed a host of strategies to enshrine the delicate neurons and their even more delicate synapse in a protective cocoon of safety. First and foremost, the brain is floating in water (otherwise called the cerebral spinal fluid), creating a bath without rigid inflexible supports. Within that water, the brain is suspended in a delicate spider web of suspending fibers and membranes that keep water from moving too quickly around the surface and allowing the soft brain to be gently suspended within the bony structure of the skull. The skull provides a rigid structure to contain the floating bath of fluid. Of note, the skull can be cracked and shattered as one strategy of dissipating force. This may lead to survival with subsequent healing. It is a unique and delicate bony structure around the brain, not seen anywhere else in the human body. The scalp provides an additional layer of safety. It is mobile and gives when struck, providing a few extra millimeters of deceleration distance. The scalp uniquely tears when stressed by direct blows, creating yet another mechanism of safety. The tearing creates large and dramatic scalp wounds in direct head trauma, but the brain underneath survives. Finally, the human skull is surrounded by hair, which can provide another layer of cushioning.

What are the physics of deceleration injury? The formula is simple: $\Delta$Velocity/time=Deceleration. The change in velocity is divided by time. Rigid structures striking each other have a spike of deceleration within the first 0.00001 seconds. The more rigid and brittle, the higher the G-force generated for a shorter fragment of time. The Holy Grail of injury prevention in deceleration injury is to increase the distance and therefore time during which deceleration occurs. We are familiar with automobiles and have seen the effectiveness of airbags that increase the distance of deceleration of the human torso before it strikes the steering wheel. Vehicles are also designed to crumple so that force is taken up by bending metal, collapsing frames, shattering fenders, stretching seatbelts all of which increase the distance and time over which the human inside decelerates. Each of these strategies also complements the others to have a net effect of human survival, lowing the G forces from sufficient to break bones to simple sprains, strains and bruises.

Protective helmets have, to date, failed to provide a complete cocoon of safety. If the analogy to the human head can be used, protective helmets provide a skull and the inner dura, but there is no outer layer of safety. There is no scalp. No hair. Some advances have been made with the use of external foam with the SG Helmet. The missing ingredient in foam is that it fails to "fail". The human scalp tears and gives way. Foam doesn't tear. It does provide distance for greater deceleration, resulting in reduction of concussion injuries.

It appears that the prior art does not teach or suggest the use of gas cells to create a more fluid means of slowing down deceleration and increasing the time/distance over which the deceleration occurs. The value of gas cells is that they easily deform, have little weight, stretch, deform rapidly with increasing resistance and, in extreme circumstances, burst. Bursting is a critical component, as it allows for the dissipation of force and then allows distance to increase as the next layer of cells can absorb the evolving contact. However, the essential stretching and increasing air pressure upon contact makes for a gradient of deceleration, which will provide protection. Foam deforms but is not as fluid as gas cells, has greater weight, which may result in rotational injuries of the neck. The foam cannot burst thereby dissipating energy.

U.S. Pat. No. 3,872,511 to Nichols discloses protective headgear. U.S. Pat. No. 3,999,220 to Keltner discloses air cushioned protective gear. U.S. Pat. No. 4,586,200 to Poon discloses a protective crash helmet. U.S. Pat. No. 5,129,107 discloses an inflatable safety helmet specially for motorcycling.

Accordingly, there is a clearly felt need in the art for a helmet having blunt force trauma protection, which includes an external replaceable impact layer that covers a rigid helmet and extinguishes an instantaneous G-force deceleration shock wave applied to the rigid helmet.

SUMMARY OF THE INVENTION

The present invention provides a helmet having blunt force trauma protection, which includes a replaceable impact layer. The helmet having blunt force trauma protection (blunt force helmet) includes a prior art helmet and a replaceable impact layer. The prior art helmet may be any type of helmet, such as a football helmet, a motorcycle helmet, a bicycle helmet, a baseball helmet, lacrosse helmet or any type of protective helmet for a human head. The replaceable impact layer preferably includes at least one gas cell layer, a removable attachment system and an outer layer of sheet material. The at least one gas cell layer includes a plurality of gas cells created between two plastic sheets. The gas is preferably air, but could be any other suitable gas, such as substantially pure nitrogen or argon. Each cell will burst upon a pre-determined impact. The plurality of cells preferably have a hexagon shape, but other shapes may also be used, such as round or square. The removable attachment system is preferably hook and loop fasteners, but other suitable removable attachment systems may also be used. At least one first pad of hook and loop fasteners is attached to an exterior surface of a prior art helmet and at least one second pad of hook and loop fasteners is attached to a bottom surface of the replaceable impact layer.

Accordingly, it is an object of the present invention to provide a blunt force trauma protection, which includes an external replaceable impact layer that covers a rigid helmet and extinguishes an instantaneous G-force deceleration shock wave applied to the rigid helmet.

These and additional objects, advantages, features and benefits of the present invention will become apparent from the following specification.

DETAILED DESCRIPTION OF THE PREFERRED EMBODIMENTS

Figure 1:
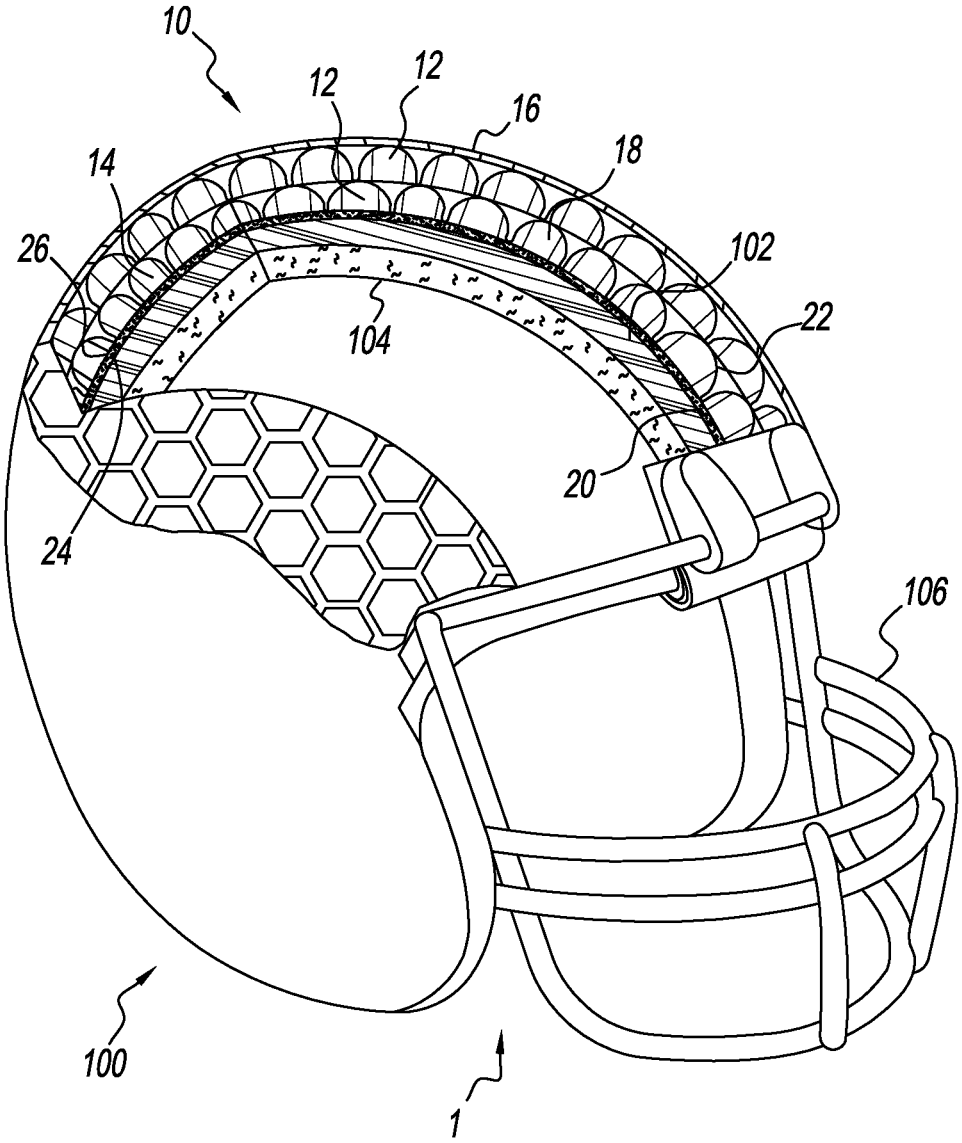
FIG. 1 is a perspective cut-away view of a blunt force football helmet with a replaceable impact layer having two gas cell layers in accordance with the present invention.
Figure 1A:
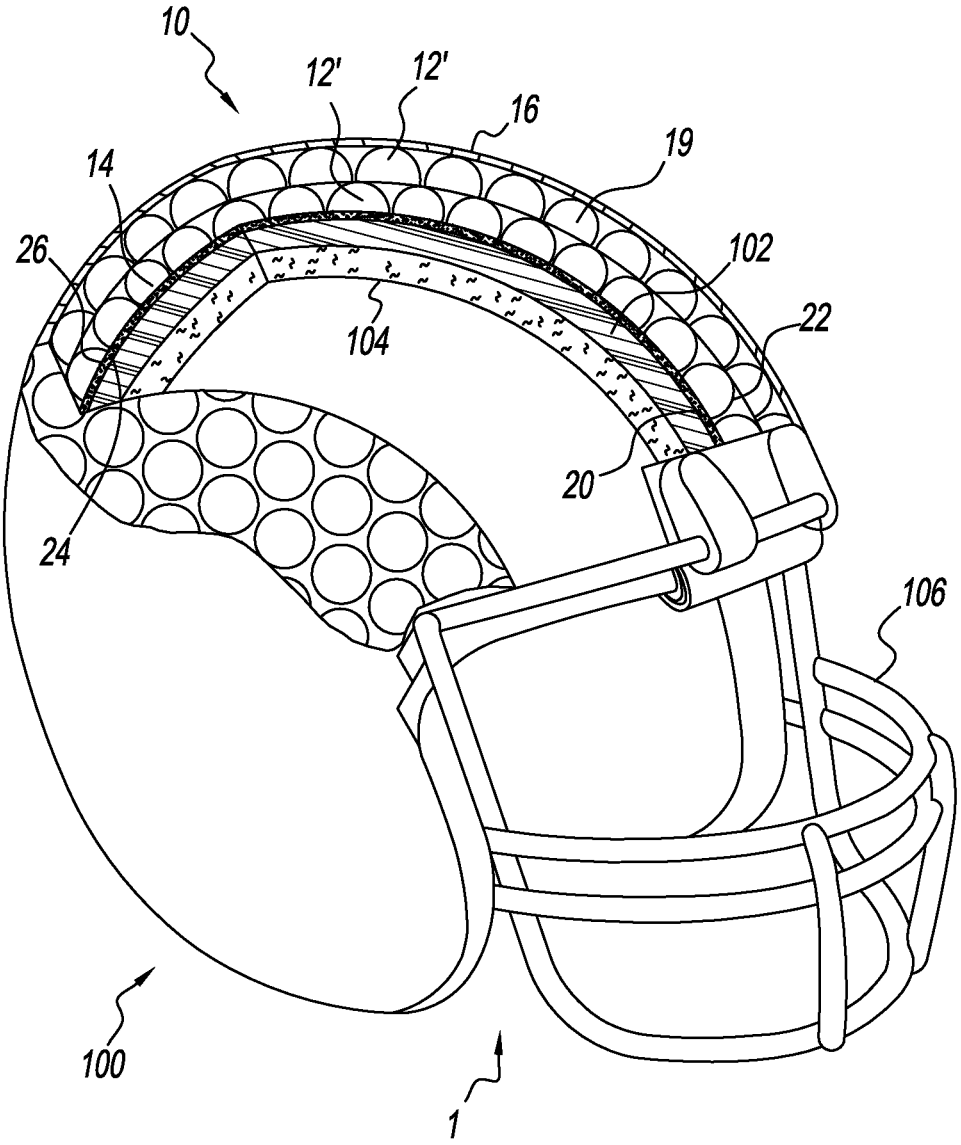
FIG. 1*a* is a perspective cut-away view of a blunt force football helmet with a replaceable impact layer having two gas cell layers with round gas cells in accordance with the present invention.
Figure 2:
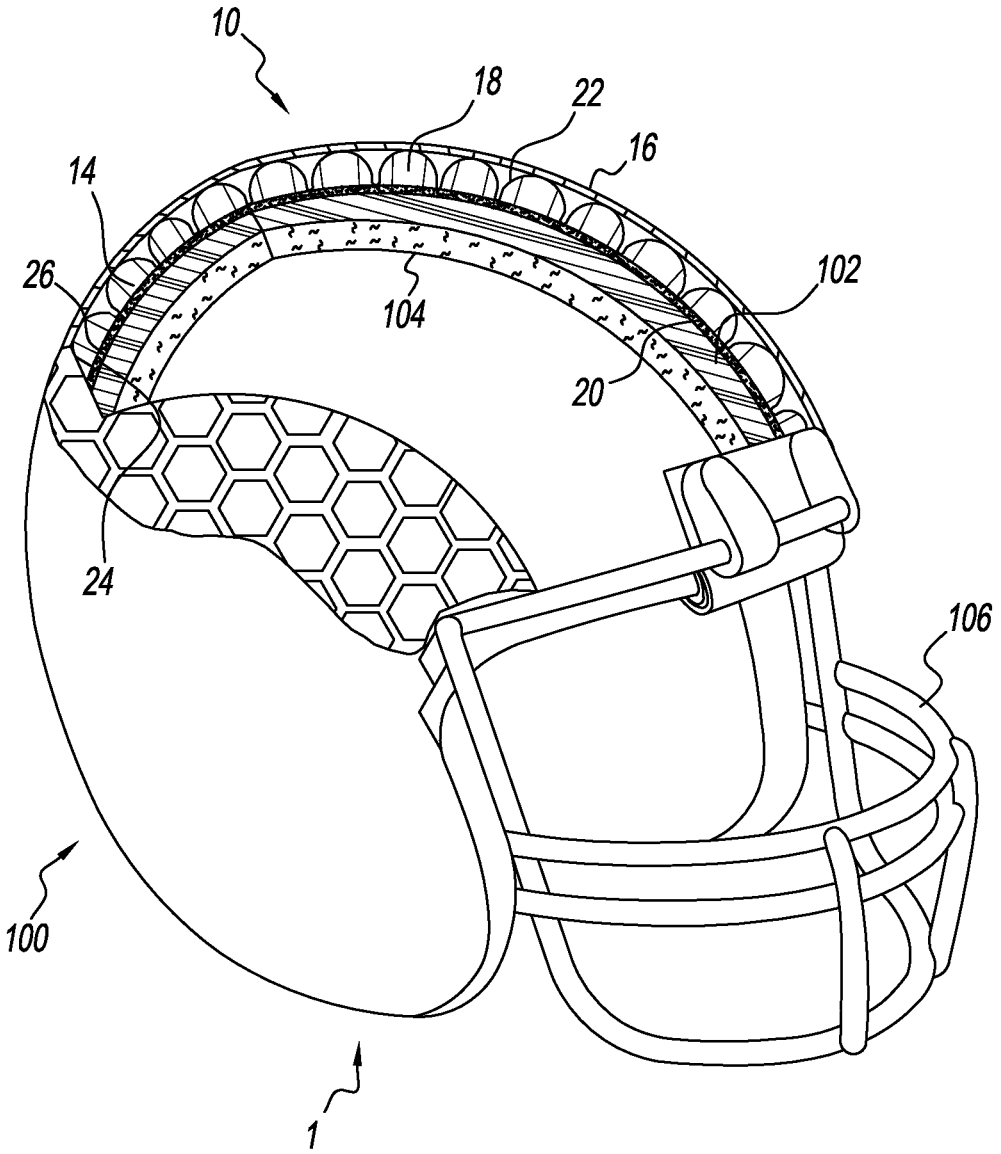
FIG. 2 is a perspective cut-away view of a blunt force football helmet with a replacement impact layer having a single a gas cell layer in accordance with the present invention.

With reference now to the drawings, and particularly to FIG. 1, there is shown a perspective cut-away view of a blunt force football helmet 1. The blunt force helmet 1 includes a prior art helmet and a replaceable impact layer 10. The prior art helmet may be any type of helmet, such as a football helmet 100, a motorcycle helmet, a bicycle helmet, a baseball helmet, lacrosse helmet or any type of protective helmet for a human head. The football helmet 100 includes a hard exterior shell 102, a padded interior 104 and a face mask 106. With reference to FIG. 2, the replaceable impact layer 10 preferably includes at least one gas cell layer 12, a removable attachment system 14 and an outer layer of sheet material 16. The at least one gas cell layer 10 includes a plurality of gas cells 18 created by a base sheet 20 and a cell sheet 22. Each of the gas cells 18 will burst upon a pre-determined impact. The gas is preferably air, but could be any other suitable gas, such as substantially pure nitrogen or argon. The following value is given by way of example and not way of limitation. It is preferably that the plurality of cells 18 burst in response to an impact of about 40 gs. The plurality of gas cells 18 preferably have a hexagon shape, but other shapes may also be used, such as round or square. FIG. 1*a* discloses two gas cell layers 12' with a plurality of gas cells 19 having a round shape. The removable attachment system 14 is preferably hook and loop fasteners, but other suitable removable attachment systems may also be used. At least one first pad 24 of hook and loop fasteners is attached to an exterior surface of the shell 102 and at least one second pad 24 of hook and loop fasteners is attached to a bottom surface of the replaceable impact layer 10. The outer layer of sheet material 16 is preferably attached to a top surface of the gas cell layer 12 with adhesive or any other suitable method.

Figure 3:
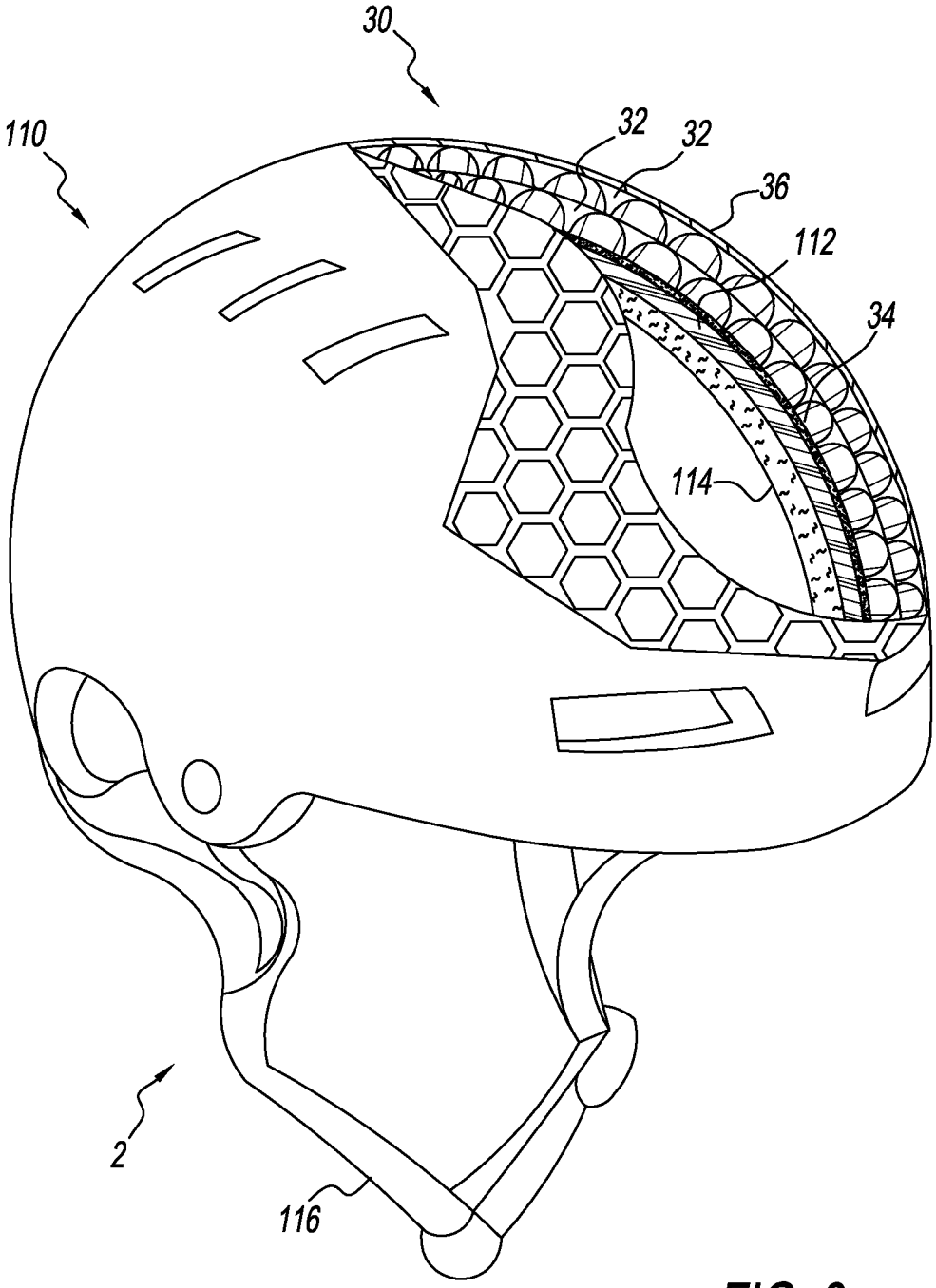
FIG. 3 is a perspective cut-away view of a blunt force bicycle helmet with a replacement impact layer having two gas cell layers in accordance with the present invention.

With reference to FIG. 3, a blunt force helmet 2 includes a bicycle helmet 110 and the replaceable impact layer 30. The bicycle helmet 110 includes a hard exterior shell 112, a padded interior 114 and a strap 116. The replaceable impact layer 30 preferably includes two gas cell layers 32, a removable attachment system 34 and an outer layer of sheet material 36. The replaceable impact layer 30 has all the features of replaceable impact layer 10. A top of a first gas cell layer 32 is attached to a bottom of a second gas cell layer 32 with adhesive or any other suitable method. The removable attachment system 34 has all the features of the replaceable impact layer 14.

The gas cells 18 on the blunt force helmets 1, 2 will burst in the area of the impact, when a force of about 40 gravitational units (40 gs) is experienced by someone wearing the blunt force helmets 1, 2. A gravitational unit is equal to 9.801 $m/s^2$. Damaged replaceable impact layers 10, 30 are removed from the blunt force helmets 1, 2 and replaced with new replaceable impact layers 10, 30. The outer layer of sheet material 16, 36 allows identification, such as team identification or advertising to be printed on an outside surface of the replacement layer 10, 30.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A helmet having blunt force trauma protection comprising:

a helmet for protecting a human head;

a replaceable impact layer includes at least one fluid cell layer, one of said at least one fluid cell layer includes a base sheet and a cell sheet, a plurality of fluid cells are created by joining said cell sheet to said base sheet, some of said plurality of cells will burst upon a predetermined impact value; and a removable attachment system for removable attachment of said at least one fluid cell layer having said plurality of fluid cells to an outside surface of said helmet.

2. The helmet having blunt force trauma protection of claim 1, further comprising:

an outer layer of sheet material is attached to said cell sheet.

3. The helmet having blunt force trauma protection of claim 1 wherein:

said plurality of cells having a shape of at least one of hexagon, round and square.

4. The helmet having blunt force trauma protection of claim 1 wherein:

said removable attachment system includes at least one first attachment pad and at least one second attachment pad.

5. The helmet having blunt force trauma protection of claim 4 wherein:

said at least one first attachment pad and at least one second attachment pad include hook and loop fasteners.

6. The helmet having blunt force trauma protection of claim 1 wherein:

said helmet is one of a football helmet, a motorcycle helmet, a bicycle helmet, a baseball helmet, a lacrosse helmet, an ice hockey helmet, a horseback riding helmet, a skiing helmet, a lacrosse helmet, a construction and military combat helmet.

7. The helmet having blunt force trauma protection of claim 1 wherein:

said fluid being one of air, substantially pure nitrogen and argon.

8. A helmet having blunt force trauma protection comprising:

a helmet for protecting a human head;

a replaceable impact layer includes at least one fluid cell layer, one of said at least one fluid cell layer includes a base sheet and a cell sheet, a plurality of fluid cells are created by joining said cell sheet to said base sheet, some of said plurality of cells will burst upon an impact value of 40 gs; and a removable attachment system for removable attachment of said at least one fluid cell layer having said plurality of fluid cells to said helmet, wherein said removable attachment system is secured to said base sheet and an outer surface of the helmet.

9. The helmet having blunt force trauma protection of claim 8, further comprising:

an outer layer of sheet material is attached to said cell sheet.

10. The helmet having blunt force trauma protection of claim 8 wherein:

said plurality of cells having a shape of at least one of hexagon, round and square.

11. The helmet having blunt force trauma protection of claim 8 wherein:

said removable attachment system includes at least one first attachment pad and at least one second attachment pad.

12. The helmet having blunt force trauma protection of claim 11 wherein:

said at least one first attachment pad and at least one second attachment pad include hook and loop fasteners.

13. The helmet having blunt force trauma protection of claim 8 wherein:

said helmet is one of a football helmet, a motorcycle helmet, a bicycle helmet, a baseball helmet, a lacrosse helmet, an ice hockey helmet, a horseback riding helmet, a skiing helmet, a lacrosse helmet, a construction and military combat helmet.

14. The helmet having blunt force trauma protection of claim 8 wherein:

said fluid being one of air, substantially pure nitrogen and argon.

15. A replaceable impact layer for attachment to a helmet for blunt force trauma protection comprising:

at least one fluid cell layer, one of said at least one fluid cell layer includes a base sheet and a cell sheet, a plurality of fluid cells are created by joining said cell sheet to said base sheet, some of said plurality of cells will burst upon an impact value of 40 gs; and a removable attachment system for removable attachment of said at least one fluid cell layer having said plurality of fluid cells to said helmet, wherein said removable attachment system is secured to said base sheet and an outer surface of a helmet, said helmet protects a human head.

16. The replaceable impact layer for attachment to a helmet for blunt force trauma protection of claim 15, further comprising:

an outer layer of sheet material is attached to said cell sheet.

17. The replaceable impact layer for attachment to a helmet for blunt force trauma protection of claim 15 wherein:

said plurality of cells having a shape of at least one of hexagon, round and square.

18. The replaceable impact layer for attachment to a helmet for blunt force trauma protection of claim 15 wherein:

said removable attachment system includes at least one first attachment pad and at least one second attachment pad.

19. The replaceable impact layer for attachment to a helmet for blunt force trauma protection of claim 15 wherein:

said at least one first attachment pad and at least one second attachment pad are include hook and loop fasteners.

20. The replaceable impact layer for attachment to a helmet for blunt force trauma protection of claim 15 wherein:

said helmet is one of a football helmet, a motorcycle helmet, a bicycle helmet, a baseball helmet, a lacrosse helmet, an ice hockey helmet, a horseback riding helmet, a skiing helmet, a lacrosse helmet, a construction and military combat helmet.

* * * * *